US005755931A

United States Patent [19]

Schiel

[11] Patent Number: 5,755,931

[45] Date of Patent: May 26, 1998

[54] METHOD AND APAPRATUS FOR PRESERVING A PRESS ROLL JACKET

[75] Inventor: Christian Schiel, Heidenheim, Germany

[73] Assignee: Voith Sulzer Papiermaschinen GmbH, Germany

[21] Appl. No.: 735,898

[22] Filed: Oct. 23, 1996

[30] Foreign Application Priority Data

Nov. 2, 1995 [DE] Germany ..... 195 40 898.5

[51] Int. Cl.[6] ..... D21F 3/02

[52] U.S. Cl. ..... 162/206; 162/272; 162/358.3; 100/38; 100/310; 100/332

[58] Field of Search ..... 162/205, 206, 162/272, 275, 276, 358.3, 361; 100/38, 93 RP, 305, 308, 310, 332

[56] References Cited

U.S. PATENT DOCUMENTS

| | | | |
|---|---|---|---|
| 3,198,694 | 8/1965 | Justus | 162/358.1 |
| 3,770,578 | 11/1973 | Spurrell | 162/206 |
| 4,555,305 | 11/1985 | Steiner et al. | 162/205 |
| 4,563,245 | 1/1986 | Wanke et al. | 162/361 |
| 4,767,501 | 8/1988 | Laapotti | 162/358.1 |
| 4,880,502 | 11/1989 | Wedel | 162/358.5 |
| 5,289,766 | 3/1994 | Conrad | 162/361 |
| 5,520,782 | 5/1996 | Schiel | 162/360.3 |

FOREIGN PATENT DOCUMENTS

| | | |
|---|---|---|
| 0042497 | 8/1984 | European Pat. Off. . |
| 4301750 | 7/1994 | Germany . |

*Primary Examiner*—Karen M. Hastings
*Attorney, Agent, or Firm*—Ostrolenk, Faber, Gerb & Soffen, LLP

[57] ABSTRACT

A method and apparatus for treating a fiber paper web in a press device wherein the web is guided through a press nip form between a press roll and a backing element in the form of a backing roll, and wherein the press roll includes a surrounding roll jacket comprised of plastic and a stationary cross head axially traversing the roll jacket. Preserving the roll jacket by cooling the roll jacket at least areawise in the axial direction of the roll jacket which increases the abrasion resistance of the roll jacket. Various devices for cooling the roll jacket include spraying coolant at the outer surface of the roll jacket, spraying coolant at the surface of a felt belt which then engages the roll jacket in a press nip, blowing air into the outlet end of the press nip between the roll jacket and the felt belt and/or blowing air into the space surrounding the outer surface of the roll jacket, e.g., the interior of the loop of the felt belt or the interior of a liquid collecting pan surrounding the roll jacket.

45 Claims, 3 Drawing Sheets

METHOD AND APAPRATUS FOR PRESERVING A PRESS ROLL JACKET

BACKGROUND OF THE INVENTION

The present invention relates to a method and apparatus for preserving the roll jacket of a shoe press roll of a paper machine press device, particularly through selectively cooling a surface of the jacket and, particularly the surface that faces outward toward the web or toward the felt at the web that is or are passing through the extended nip formed at the shoe press. More generally, the method and apparatus are involved with treating a fiber web or a paper web in a press device in an elongate or extended nip press.

The web is guided through a press nip formed between a press roll and a backing element, which is preferably a backing roll. The press nip defines an especially elongate press zone, usually because the press roll is a shoe press roll. The press roll has a surrounding roll jacket that is comprised of plastic, particularly polyurethane. A stationary cross head or beam traverses the roll jacket axially. The roll jacket is pressable in the direction of the backing element by a press shoe that is supported on the cross head by at least one support element.

In paper making machines, especially in the wet press area, press devices using a so-called elongate press zone (or extended nip, long nip, wide nip) are frequently employed, as known, for example, from U.S. Pat. No. 4,555,305. A press device using an elongate press zone has a press nip that is usually formed between a press roll with a flexible roll jacket and a rigid backing roll. The press roll includes a fixed cross head or beam around which a flexible, endless loop, roll jacket, sometimes also called a press jacket, rotates. The roll jacket may be supported at its ends by co-rotating tensioning disks.

A press shoe which is continuous and is pressable toward the backing element is provided between the cross head and the roll jacket. The shoe is supported by one or more support elements supported on the cross head. Where the backing element is a backing roll, the supporting surfaces of the support elements facing the backing roll are designed concavely, essentially to complement the shape of the outer circumference of the backing roll, producing a generally uniform thickness press zone for the web between the press shoe and the backing roll.

Press devices of this kind having an elongate press zone have proven satisfactory. However, their flexible roll jackets have short service lives due to the low abrasion resistance of the polymer material layers provided on the outside of the roll jacket. This makes the roll jackets not necessarily well suited for use in high speed paper machines.

To correct this problem, attempts have been made to increase the abrasion resistance of the polymer used in the roll jacket by using other molecular structures. However, these attempts have not yielded satisfactory results since the increase in abrasion resistance has always been coupled with an undesired increase in the brittleness of the polymer layers.

Particularly in the case of high speed, high performance paper machines, in which the paper web is considerably heated before it reaches the press device, in order to achieve the high final dryness required for stable travel of the paper web, long service life of the roll jacket is especially important.

SUMMARY OF THE INVENTION

The primary object of the invention is to increase the service life of the roll jacket of the press roll of a shoe press or an extended nip press.

Another object of the invention is to provide a method and a device for treating fiber or paper webs in an extended nip press for increasing the service life of the roll jacket.

The objects are achieved according to the invention by increasing the abrasion resistance of the roll jacket of the press roll. For this purpose, the outer surface of the roll jacket, and particularly the surface that faces toward the web or toward the felt moving with the web through the nip, is cooled, at least areawise, i.e., selectively in different areas over the axial direction or length of the roll. A device according to the invention for treating a fiber or paper web therefore includes a cooling device to cool the outer surface of the roll jacket, at least areawise, in the axial direction of the press roll.

It has been found that the cooling of the outer surface of the roll jacket according to the invention can considerably increase the abrasion resistance of conventional roll jackets made of polymers, especially polyurethanes. This advantageous effect, which is caused by cooling only the outer surface of the roll jacket, is surprising because no wear problems occur at the inside or shoeward facing side of the roll jacket where high temperatures also may prevail. As a result, no direct negative influence of high temperature on abrasion resistance could have previously been assumed.

In theory, it might be sufficient to cool the roll jacket only in those areas that are heated strongly, for example, near the axial middle region of the roll in particular. In a preferred embodiment, however, the jacket is advantageously cooled over the entire axial length of the press roll, although areawise.

The roll jacket outer surface should be kept at a temperature below 50° C. and possibly below 45° C., because when the jacket surface is above these temperature limits, it has been found that the abrasion resistance of the plastic layer on the outside of the roll jacket decreases sharply.

The outer surface of the roll jacket can be cooled advantageously by directing a coolant stream against the outer surface of the endless loop roll jacket at any selected location along its loop path, e.g., just before the pressing zone, just after, or away from that zone.

Alternatively or in addition, when the web to be treated is guided on a felt belt through the press nip, it is also possible to cool the felt belt on its surface that thereafter comes in contact with the roll jacket. The cooled felt belt in turn cools the outer surface of the roll jacket in the press nip. The felt belt between them also counteracts the transfer of heat from the warm fiber web to the roll jacket.

Alternatively or in addition, a coolant stream may also be directed into the nip between the felt belt and the roll jacket at the outlet from the press zone, so that the roll jacket and the felt belt are cooled in the same way. Since the felt belt and the roll jacket surface are hottest at the outlet from the press zone, the cooling effect that can be achieved by the coolant stream at this point is comparatively high.

Cold water or cold and/or unsaturated air can be used as the coolant, for example and each can be selected for use at any of the above noted locations. Preferred locations for applying each cooling medium are described below. The water or air is directed against the outer surface of the roll jacket and/or the felt belt.

Other features and advantages of the present invention will become apparent from the following description of the invention which refers to the accompanying drawings.

DETAILED DESCRIPTION OF EMBODIMENTS OF THE INVENTION

Figure 1:
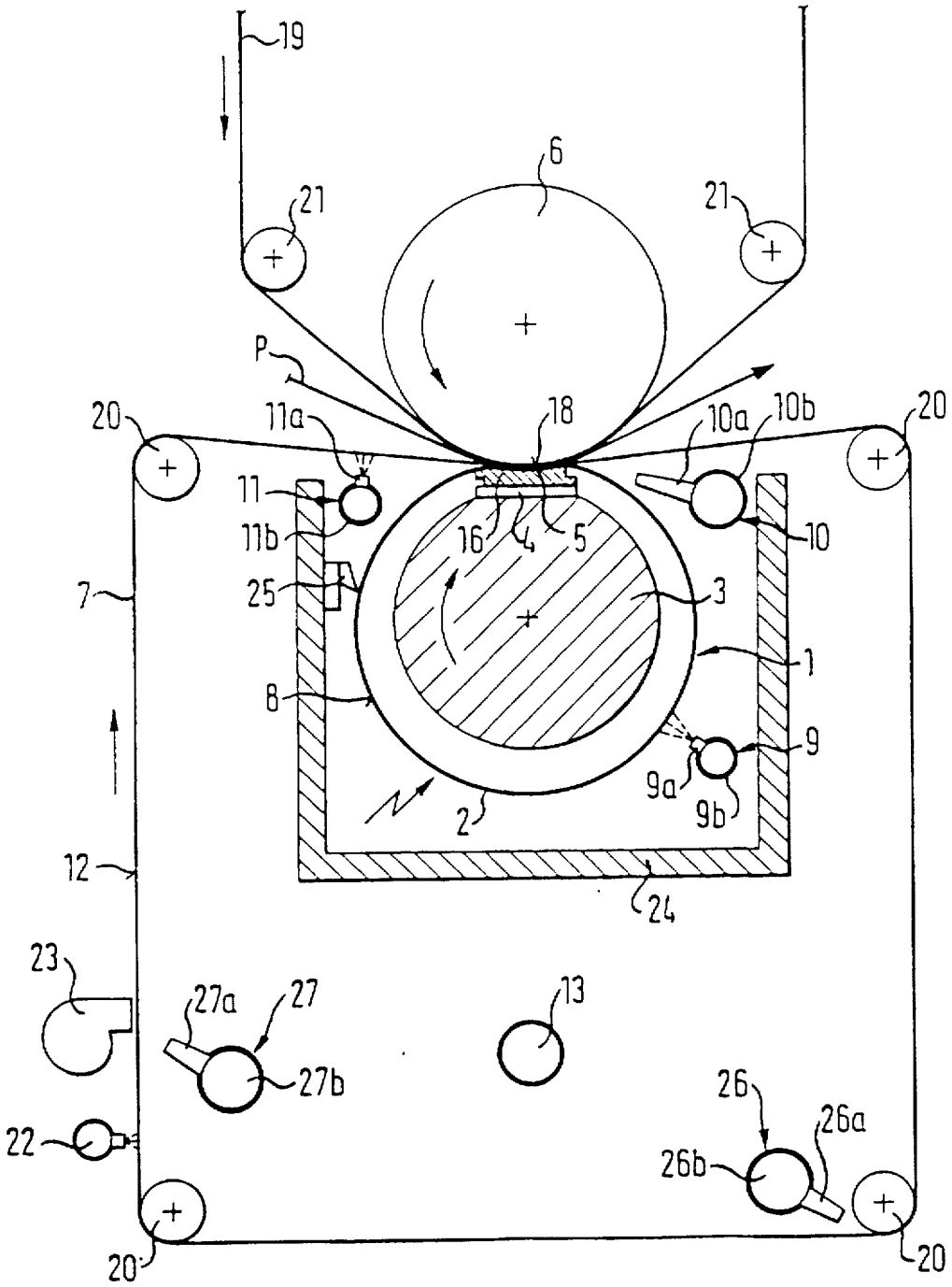
FIG. 1 is a schematic vertical section through a first embodiment of a press device according to the invention.

FIG. 1 shows a first embodiment of a press device for treating a fiber or paper web P according to the present invention. The device includes a shoe press roll 1 that cooperates with a backing roll 6 to form an elongate press nip 5. A web P to be treated, e.g., pressed for dewatering it, is transported through that nip.

Press roll 1 includes a surrounding, endless loop, flexible roll jacket 2 comprised of a plastic, especially a polymer and preferably of polyurethane, and comprised of one or of several layers. A stationary cross head or beam 3 traverses the roll jacket 2 axially. The cross section of the loop of the roll jacket is larger than the cross section of the beam. The roll jacket 2 is pressable, by a press shoe 16 supported on the cross head 3, against the backing roll 6. The shoe is supported by a plurality of hydraulic support elements 4 located side by side along the axial direction of the press roll 1 and the support elements are chargeable separately from one another. Alternatively, the press shoe 16 can be located in a pressure plenum in the cross head 3. The support surface 18 of the press shoe 16, which is opposed to the backing roll 6, is shaped generally complementary to the outer surface of the backing roll 6 to form an elongate or extended nip press zone.

The web P to be treated is guided through the cress nip 5 between two endless loop felt belts, 7 below and 19 above, that run over guide rolls, 20 below and 21 above, to form respective closed loops 7 and 19.

A cleaning device is provided to clean the surface of the felt belt 7 that passes in contact with the web P. It includes a cleaning spray tube 22 through which a cleaning fluid is applied to the outer surface 12 of the felt belt 7. A suction device 23 located further in the direction of transport of the felt belt 7 after the cleaning spray tube 22 sucks the cleaning fluid containing the fibers and contaminants off the felt belt 7.

The press roll 1 is surrounded by a pan 24 that catches spray that is flung off the rotating roll jacket 2 by centrifugal force. A wiper 25 provided on the inside of the pan 24 wipes off water adhering to the roll jacket 2 and deposits it in the pan 24.

A first spray device 9 in the pan 24 directly cools the outer surface of the roll jacket 2. The spray device 9 comprises a plurality of nozzles 9*a* that are directed at the roll jacket 2 of press roll 1. The nozzles are arranged side by side in the lengthwise direction X of the press roll 1. They spray cold water over the entire length of the outer surface 8 of the roll jacket 2. The water is supplied by a supply line.

A second spray device 10 is provided in the upper area of the pan 24 at the outlet of the press zone. It comprises a plurality of nozzles 10*a* also distributed side by side in the axial direction of the press roll 1. Those nozzles are directed into the nip between the felt belt 7 and the roll jacket 2 at the outlet from the press zone. They blow a cooling air stream, which is supplied by a supply line 10*b*, into the nip.

In addition, a third spray device 11 cools the inward surface of the felt belt 7 before it comes into contact with the roll jacket 2 of press roll 1 and shortly before the felt belt enters the press zone 5. Spray device 11 comprises a plurality of nozzles 11*a* distributed over the width of the felt belt 7, i.e., in direction X. Those nozzles are supplied with cold water by a common supply line 11*b*. They direct a stream of cooling water against the surface 12 of the felt belt 7 that then comes in contact with the roll jacket 2.

Two additional fourth and fifth spray devices 26, 27 for cooling the felt belt 7 with air are provided in the vicinity of the inward facing surface of the felt belt loop. Each device 26, 27 comprises a respective plurality of nozzles 26*a*, 27*a* that are distributed over the width of the felt belt 7, i.e., in direction X. Those nozzles are supplied with cooling air by respective supply lines 26*a*, 27*a*. Spray devices 26, 27 are located along the transport direction of felt belt 7. Each of the devices is located immediately downstream from a respective one of the guide rolls 20 over which the felt belt 7 is guided.

An air supply line 13 outlets into the loop formed by the felt belt 7 to blow dry ambient air into the felt belt loop. This dry ambient air distributes itself inside the felt belt loop, and the air is saturated with the moisture in the area of the belt loop, producing cooling of the felt belt by evaporation.

The air supply to each of air supply line 10 *b* and/or line 13 may be from a separate ventilation system for the drive motors of the driven elements of the press device.

Valves are associated with nozzles 9*a* of the first spray device 9 that directly cools the outer surface 8 of the roll jacket 2 with cold water and associated with the nozzles 11*a* of the third spray device 11 that cools the felt belt 7 with cold water shortly before it enters the press nip 5. The valves can differentially adjust the volume of cooling water supplied to the nozzles 9*a*, 11*a* along the axial direction X of the press roll 1. This enables a desired temperature profile to be set along the axial direction of the roll jacket 2. In particular, the roll jacket 2 can be cooled such that the temperature of the roll jacket surface along the axial direction of the press roll 1 is essentially constant.

Alternatively or in addition, the temperature profile can also be controlled along the axial direction of the press roll 1 by positioning the nozzles 9*a*, 11*a* side by side along the axial direction of the press roll 1 and supplying the with coolant at respective different temperatures.

Figure 2:
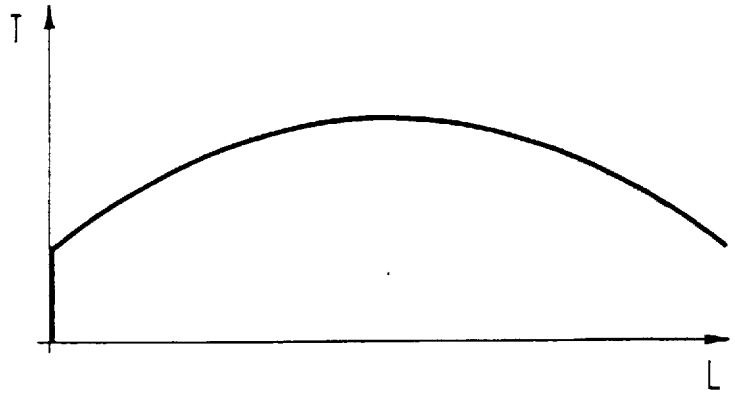
FIG. 2 is a graph showing a temperature pattern established on the outer surface of a roll jacket over the lengthwise or axial direction of the press roll during operation without cooling the roll jacket.

During operation, the web P is sandwiched between felt belts 7, 19 and the web and the felt belts are guided through the press nip 5 of the press device. The felt belts 7, 19, as well as the roll jacket 2 of the press roll 1 and the backing roll 6 are heated by the warm web P, which has a temperature that can reach a level of about 700° to 90° C. As shown in FIG. 2, the temperature of the roll jacket 2 is usually highest in the axial middle section of the press roll 1 and drops off toward the lateral edges, i.e., the ends of the roll.

Figure 3:
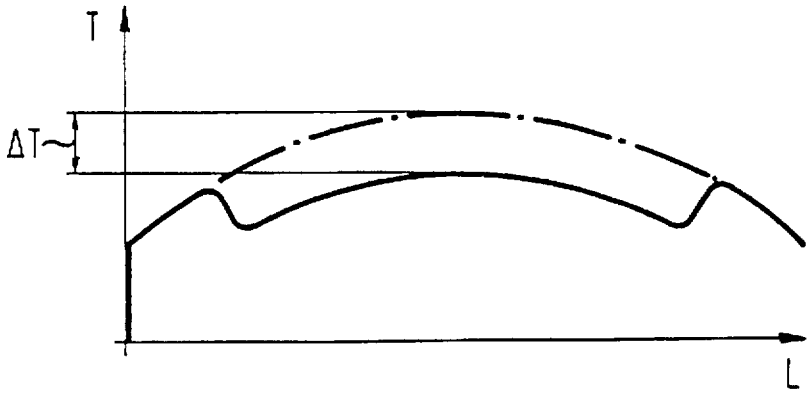
FIG. 3 is a graph showing the temperature pattern on the outer surface of a roll jacket over the length of a press roll of a press device according to the invention.

The first to fifth spray devices 9, 10, 11, 26, 27 adjust the temperature of the outer surface 8 of the roll jacket 2, as shown in FIG. 3, to decrease in the middle area of the press roll i by a value $\Delta T$. The outer surface is preferably held to a temperature below 50° C.

The first spray device 9 that sprays cold water on the outer surface 8 of the roll jacket 2 causes direct cooling of the roll jacket 2. That cooling is variable in the axial direction of the roll jacket 1 by suitably setting the valves associated with the nozzles 9*a*.

The third spray, device 11 also produces cooling of the felt belt 7 shortly before it enters the press zone 5. The felt belt 7 then cools the roll jacket 2 in the press zone 5 and also prevents heat from being transferred from the web P to the roll jacket 2.

At the outlet of the press zone, a cooling air stream is blown by the second spray device 10 into the nip between the felt belt 7 and the roll jacket 2. That air stream is preferably taken from a separate ventilating system for the drive motors of the press device. That simultaneously cools the felt belt 7 and the roll jacket 2, so that a high cooling effect is achieved because of the comparatively high temperatures of the felt belt 7 and the roll jacket 2 immediately after they leave the press zone.

During the travel of the felt belt 7 around the rolls 20, it is uniformly cooled by additional spray devices 26, 27 and also by the dry air that is blown through the air feed line 13 into the felt belt loop. The felt belt is thereby freed of adhering fibers and contaminants by the cleaning device.

Figure 4:
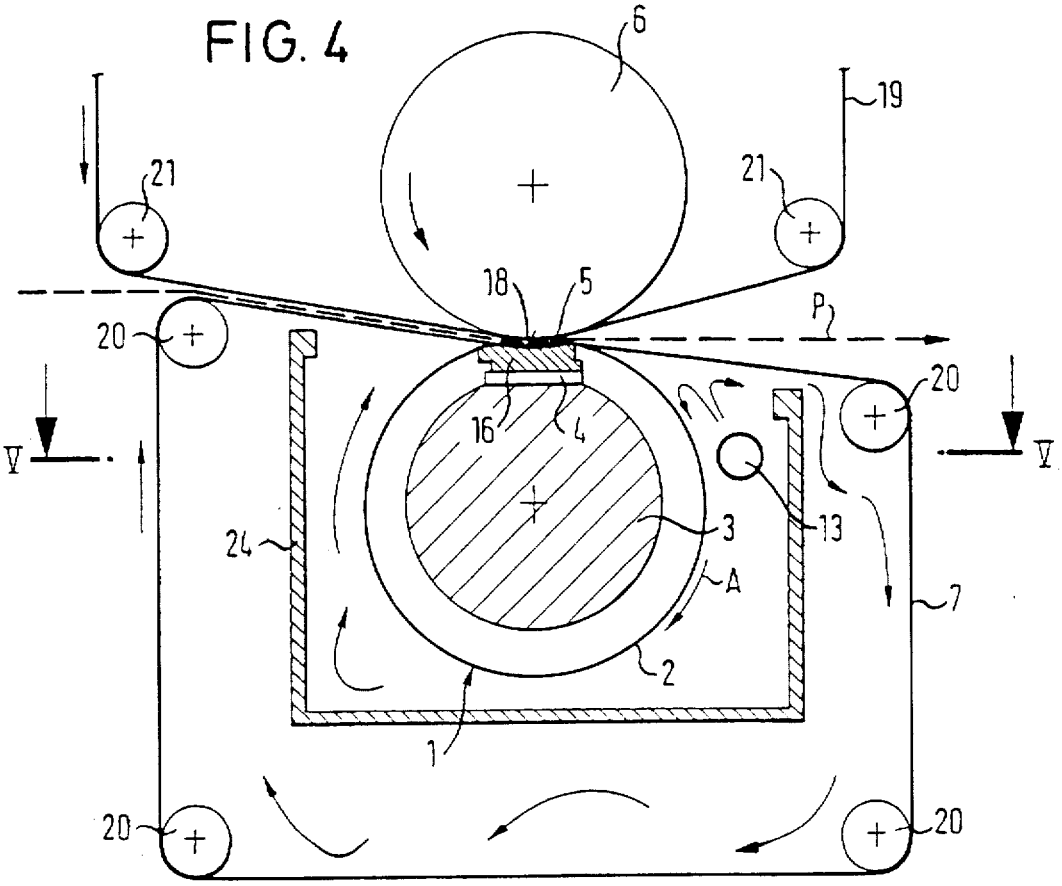
FIG. 4 is a schematic vertical section through a second embodiment of a press device according to the invention.
Figure 5:
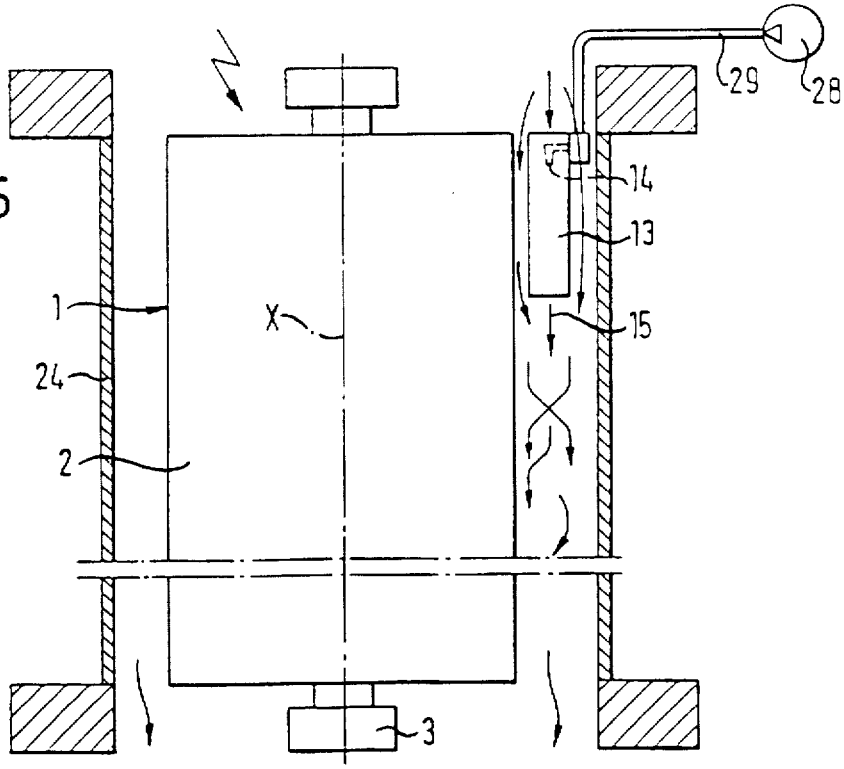
FIG. 5 shows the second embodiment of a press device of FIG. 4 in a section along line V—V in FIG. 4.

FIGS. 4 and 5 show another embodiment of a press device according to the invention with essentially the same basic structure as the press device shown in FIG. 1. It comprises a press roll 1 which cooperates with a backing roll 6 to form a press nip 5 including an elongate or extended nip press zone through which a web P to be treated is transported between two felt belts 7, 19.

The press roll 1 again comprises an endless loop, flexible roll jacket 2 comprised of plastic and a stationary cross head or beam 3 that traverses the roll jacket 2 in the axial direction. The roll jacket 2 is pressable in the direction of the backing roll 6 by a press shoe 16 in the cross head 3. The shoe is supported by hydraulic support elements 4. The contact surface 18 of the shoe which opposes and is associated with the backing roll 6 is shaped in a manner complementary to the outer surface of backing roil 6 shaped to form the elongate press nip.

The press roll 1 is surrounded by a pan 24 that is open at its lateral sides in the vicinity of the axial ends of press roll 1. It catches spray that is flung from the rotating roll jacket 2 of the press roll 1.

FIG. 5 shows an air supply tube 13 that projects into the pan 24 from one of its open sides. That tube is aligned parallel to the lengthwise axis X of the press roll 1. It blows dry air into the pan 24. The air feed tube is designed in the form of a momentum exchange tube 13 and includes an injector nozzle 14 that is inserted laterally. A cooling air stream, which is supplied under pressure through a pump 28 and a line 29, can be blown through that nozzle parallel to the axis X of the press roll 1 into the momentum exchange tube 13. The energy rich outlet stream from the injector nozzle 14 sucks ambient air into the momentum exchange tube 13 due to the momentum exchange and conducts the air into the pan 24 as a cooling air stream.

The cool dry air that is supplied by the momentum exchange tube 13 distributes itself in the pan 24 where it absorbs moisture at the moving boundary layers of the roll jacket 2 and the felt belt 7. That air is transported by the rotation of the roll jacket 2 in the direction of the arrow A to the opposite side of the press roll 1 and is blown out of pan 24. The moisture uptake by the air causes cooling by evaporation enabling the temperature of the outer surface 8 of the roll jacket 2 to be held below 45° C.

In addition, it is possible to provide direct cooling of the roll jacket 2 and/or the felt belt 7, as was described for the first embodiment in FIG. 1, and especially to deliberately set a temperature profile over the length of the press roll 1.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A method for treating a fiber or paper web in an elongate press zone of a press device, wherein the press device includes a shoe press roll including a stationary cross head supporting a shoe, a rotating endless loop roll jacket comprised of a plastic material which rotates around the cross head and over the shoe, and a backing element opposed to the shoe;

the method comprising:

rotating the roll jacket past the shoe and the backing element for defining a press nip between the roll jacket and the backing element;

passing the web through the press nip, along with the roll jacket which is located at one side of the web and along with a felt belt between the web and the press jacket, and with the backing element located at the other side of the web; and cooling the outer surface of the roll jacket that is facing toward the web, selectively in different areas along the axial direction of the roll jacket such that the abrasion resistance of the roll jacket is increased.

2. The method of claim 1, further comprising passing a second felt belt through the press nip at the opposite side of the web from the first mentioned felt belt so that the second felt belt is between the web and the backing element.

3. The method of claim 1, wherein the step of cooling comprises cooling the outer surface of the roll jacket at the areas along the axial direction of the roll jacket that are warmed to a greater extent.

4. The method of claim 1, wherein the step of cooling comprises at least attempting to hold the roll jacket outer surface at a temperature below 50° C.

5. The method claim 1, wherein the step of cooling comprises cooling the roll jacket outer surface by applying a coolant stream against the outer surface of the roll jacket.

6. The method of claim 5, wherein the stream of coolant is cold water.

7. The method of claim 1, wherein the stream of coolant is air.

8. The method of claim 1, wherein the step of cooling comprises cooling the roll jacket outer surface differentially at different axial locations along the axial direction of the press roll.

9. The method of claim 8, wherein the step of cooling comprises cooling the outer surface of the roll jacket to a greater extent at the areas of the outer surface of the roll jacket that are warmed to a greater extent.

10. The method of claim 1, wherein the step of cooling comprises indirectly cooling the outer surface of the roll jacket by directing a coolant stream against that surface of the felt belt that comes into contact with the outer surface of the roll jacket in the press nip.

11. The method of claim 10, wherein the stream of coolant is cold water.

12. The method of claim 1, wherein the one felt belt defines an endless closed loop that encloses the roll jacket;

the method comprising directing an air stream into the interior of the closed felt belt loop.

13. The method of claim 1, wherein the step of cooling comprises cooling applying a stream of coolant.

14. The method of claim 13, wherein the coolant is cold water.

15. The method of claim 13, wherein the coolant is cold air.

16. The method of claim 1, wherein the felt belt defines an endless closed loop that encloses the roll jacket.

17. A method for treating a fiber or paper web in an elongate press zone of a press device, wherein the press device includes a shoe press roll including a stationary cross head supporting a shoe, a rotating endless loop roll jacket comprised of a plastic material which rotates around the cross head and over the shoe, and a backing element opposed to the shoe;

the method comprising:

rotating the roll jacket past the shoe and the backing element for defining a press nip between the roll jacket and the backing element;

passing the web through the press nip along with the roll jacket located at one side of the web and with the backing element located at the other side of the web;

cooling the outer surface of the roll jacket facing toward the web by cooling the roll jacket outer surface differentially at different axial locations along the axial direction of the press roll by cooling the outer surface of the roll jacket to a greater extent at the areas of the outer surface of the roll jacket that have been warmed to a greater extent so that the outer surface of the roll jacket has a presettable temperature profile over the width of the roll jacket along the axial direction of the roll.

18. The method of claim 17, wherein the step of cooling comprises cooling the outer surface of the roll jacket so that the temperature of the roll jacket along the axial direction of the press roll is essentially constant.

19. The method of claim 17, wherein the step of cooling comprises at least attempting to hold the roll jacket outer surface at a temperature below 50° C.

20. The method of claim 17, wherein the step of cooling comprises applying a coolant stream against the roll jacket outer surface in a differential amount over the width of the roll jacket along the axial direction of the press roll for achieving the temperature profile over the width of the roll jacket.

21. The method of claim 20, further comprising passing a felt belt through the nip at at least one side of the web;

the step of cooling comprises directing the coolant stream into a nip formed between the felt belt and the roll jacket.

22. The method of claim 21, further comprising directing the coolant stream into the nip between the felt belt and the roll jacket at the outlet side of the press zone.

23. The method of claim 21, wherein the coolant comprises air.

24. The method of claim 23, further comprising supplying air from a separate ventilation system for drive motors of the press device to supply the coolant air.

25. A method for treating a fiber or paper web in an elongate press zone of a press device, wherein the press device includes a shoe press roll including a stationary cross head supporting a shoe, a rotating endless loop roll jacket comprised of a plastic material which rotates around the cross head and over the shoe, one felt belt that defines an endless closed loop that encloses the roll jacket and a backing element opposed to the shoe;

the method comprising:

rotating the roll jacket past the shoe and the backing element for defining a press nip between the roll jacket and the backing element;

passing the web through the press nip along with the felt belt located at one side of the web and with the roll jacket located at the one side of the web and with the felt belt between the web and the roll jacket; and with the backing element located at the other side of the web;

cooling the outer surface of the roll jacket facing toward the web along the axial direction of the roll jacket by directing the air stream into the interior of the closed felt belt loop by an injector nozzle having an energy rich outlet core stream, for drawing in quantities of unsaturated ambient air by momentum exchange, and feeding the ambient air into the felt belt loop together with the cooling air stream.

26. The method of claim 25, further comprising directing the air stream near the outlet of the roll jacket from the press zone and into the nip between the roll jacket and the felt belt on a path along the axial direction of the roll.

27. Apparatus for pressing a fiber or paper web comprising a press roll comprising a stationary cross head, a surrounding roll jacket surrounding the cross head and rotatable around the cross head, with the cross head extending through the roll jacket in the axial direction, the roll jacket being a flexible, endless loop comprised of plastic material;

a press shoe supported on the cross head and located inside the loop of the roll jacket, a support element at the cross head for pressing the press shoe against the roll jacket;

the roll jacket having an outer surface and having an opposite inner surface toward the shoe;

a backing element opposed to the press shoe and to the outer surface of the roll jacket to define a press nip for pressing the web between the roll jacket and the backing element; the shoe being of such length along the rotation direction of the roll jacket as to define a press zone that is elongated along the path of the roll jacket through the nip such that the web to be pressed can be guided through the nip above the outer surface of the roll jacket;

a felt belt that passes through the nip and that is in contact with the outer surface of the roll jacket and the web being pressed as the web, the belt and the roll jacket together pass through the nip;

a cooling device located outside the roll jacket structured and arranged for cooling the outer surface of the roll jacket selectively in different areas in the axial direction along the press roll such that the abrasion resistance of the roll jacket is increased.

28. The apparatus of claim 27, wherein the backing element comprises a rotatable backing roll which rotates along with the roll jacket.

29. The apparatus of claim 27, wherein the roil jacket is comprised of polyurethane.

30. The apparatus of claim 27, wherein the cooling device for cooling the outer surface of the roll jacket comprises a spray device for spraying a coolant stream against the outer surface of the roll jacket.

31. The apparatus of claim 30, wherein the spray device sprays a coolant stream of cold water.

32. The apparatus of claim 30, wherein the spray device sprays a coolant stream of air.

33. The apparatus of claim 30, wherein the spray device comprises a plurality of spray sections arrayed along the axial direction of the press roll and means for individually controlling each of the spray sections for controlling the spray.

34. The apparatus of claim 27, wherein the cooling device directs a coolant stream against that surface of the felt belt that comes into contact with the outer surface of the roll jacket in the nip.

35. The apparatus of claim 34, wherein the coolant stream is a stream of air.

36. The apparatus of claim 34, further comprising an air feed to blow a cooling air stream into the interior of the closed loop formed by the felt belt around the press roll.

37. The apparatus of claim 36, wherein the air feed comprises a tube having an end in the felt belt loop and having another end connected to receive ambient air.

38. The apparatus of claim 27, further comprising a liquid collecting pan surrounding the roll jacket, and the cooling device comprises a air stream for directing air into the pan to contact the outer surface of the jacket and cool the jacket.

39. The apparatus of claim 34, wherein the cooling device comprises a first spray device for spraying cooling spray of liquid against the surface of the felt belt which contacts the roll jacket prior to entry of the felt belt into the nip with the roll jacket and comprises a second spray device for spraying cooling air into the nip between the felt belt and the outer surface of the roll jacket at the outlet side from the press zone.

40. The apparatus of claim 39, further comprising apparatus for spraying liquid on the outer surface of the roll jacket for cooling the roll jacket.

41. The apparatus of claim 27, wherein the felt belt is an endless loop felt belt.

42. The apparatus of claim 41, further comprising a second felt belt between the web and the backing element and passing through the press nip along with the web and the first mentioned felt and the roll jacket.

43. Apparatus for pressing a fiber or paper web comprising:

a press roll comprising a stationary cross head, a surrounding roll jacket surrounding the cross head and rotatable around the cross head, with the cross head extending through the roll jacket in the axial direction, the roll jacket being a flexible, endless loop comprised of plastic material;

a press shoe supported on the cross head and located inside the loop of the roll jacket, a support element at the cross head for pressing the press shoe against the roll jacket;

the roll jacket having an outer surface and having an opposite inner surface toward the shoe;

a backing element opposed to the press shoe and to the outer surface of the roll jacket to define a press nip for pressing the web between the roll jacket and the backing element; the shoe being of such length along the rotation direction of the roll jacket as to define a press zone that is elongated along the path of the roll jacket through the nip such that the web to be pressed can be guided through the nip above the outer surface of the roll jacket;

a cooling device located outside the roll jacket for cooling the outer surface of the roll jacket in the axial direction along the press roll, the cooling device comprising a spray device for spraying a coolant stream against the outer surface of the roll jacket, the spray device comprising a plurality of spray sections arrayed along the axial direction of the press roll and means for individually controlling each of the spray sections for controlling the spray; and a control device to adjust the quantity and/or temperature of the coolant sprayed at each of the spray sections for achieving a presettable temperature profile of the outer surface of the roll jacket along the axial length of the press roll.

44. Apparatus for pressing a fiber or paper web comprising:

a press roll comprising a stationary cross head, a surrounding roll jacket surrounding the cross head and rotatable around the cross head, with the cross head extending through the roll jacket in the axial direction, the roll jacket being a flexible, endless loop comprised of plastic material;

a press shoe supported on the cross head and located inside the loop of the roll jacket, a support element at the cross head for pressing the press shoe against the roll jacket;

the roll jacket having an outer surface and having an opposite inner surface toward the shoe;

a backing element opposed to the press shoe and to the outer surface of the roll jacket to define a press nip for pressing the web between the roll jacket and the backing element; the shoe being of such length along the rotation direction of the roll jacket as to define a press zone that is elongated along the path of the roll jacket through the nip such that the web to be pressed can be guided through the nip above the outer surface of the roll jacket;

a cooling device located outside the roll jacket for cooling the outer surface of the roll jacket in the axial direction along the press roll, the cooling device comprising a spray device for spraying a coolant stream against the outer surface of the roll jacket;

the spray device comprises a plurality of spray sections arrayed along the axial direction of the press roll and means for individually controlling each of the spray sections for controlling the spray; and the spray device has an outlet at the outlet of the press nip so that the spray is directed into the nip between the felt belt and the roll jacket.

45. Apparatus for pressing a fiber or paper web comprising a press roll comprising a stationary cross head, a surrounding roll jacket surrounding the cross head and rotatable around the cross head, with the cross head extending through the roll jacket in the axial direction, the roll jacket being a flexible, endless loop comprised of plastic material;

a press shoe supported on the cross head and located inside the loop of the roll jacket, a support element at the cross head for pressing the press shoe against the roll jacket;

the roll jacket having an outer surface and having an opposite inner surface toward the shoe;

a backing element opposed to the press shoe and to the outer surface of the roll jacket to define a press nip for pressing the web between the roll jacket and the backing element; the shoe being of such length along the rotation direction of the roll jacket as to define a press zone that is elongated along the path of the roll jacket through the nip such that the web to be pressed can be guided through the nip above the outer surface of the roll jacket;

a felt belt that passes through the nip and between the outer surface of the roll jacket the web being pressed as the web, the felt belt and the roll jacket together pass through the nip;

a cooling device located outside the roll jacket for cooling the outer surface of the roll jacket in the axial direction along the press roll, the cooling device comprising an air feed for blowing a cooling air stream into the interior of the closed loop formed by the felt belt around the press roll and against that surface of the felt belt that comes into contact with the outer surface of the roll jacket in the nip, the air feed comprising a tube having an end in the felt belt loop and having another end connected to receive ambient air; the air feed tube comprises a momentum exchange tube having an injector nozzle with an outlet opening pointing in the lengthwise direction of the momentum exchange tube, the cooling air stream being blowable through the injector nozzle of the momentum exchange tube for defining an energy rich outlet stream from the injector nozzle, the momentum exchange tube being open to suck ambient air into the momentum exchange tube due to the momentum exchange, and the nozzle being shaped to guide the ambient air together with the cooling air stream into the interior of the felt belt loop.

* * * * *